US007905009B2

(12) United States Patent
Pauley, Jr. et al.

(10) Patent No.: US 7,905,009 B2
(45) Date of Patent: Mar. 15, 2011

(54) METHOD OF FORMING A TRANSFORMER COIL

(75) Inventors: William E. Pauley, Jr., Bland, VA (US); Rush Horton, Jr., Wytheville, VA (US); Charlie H. Sarver, Rocky Gap, VA (US); Curtis H. Frye, Saltville, VA (US)

(73) Assignee: ABB Technology AG, Zurich (CH)

( * ) Notice: Subject to any disclaimer, the term of this patent is extended or adjusted under 35 U.S.C. 154(b) by 76 days.

(21) Appl. No.: 11/752,986

(22) Filed: May 24, 2007

(65) Prior Publication Data

US 2007/0220738 A1 Sep. 27, 2007

Related U.S. Application Data

(62) Division of application No. 10/858,039, filed on Jun. 1, 2004, now Pat. No. 7,688,170.

(51) Int. Cl.
*H01F 7/127* (2006.01)
*H01F 5/02* (2006.01)

(52) U.S. Cl. ..... 29/602.1; 29/606; 29/841; 336/185; 336/196

(58) Field of Classification Search ..... 29/602.1, 29/605, 606, 604, 841; 336/96, 205, 206, 336/84 R, 185, 196
See application file for complete search history.

(56) References Cited

U.S. PATENT DOCUMENTS

| | | | | |
|---|---|---|---|---|
| 1,495,823 | A | 1/1921 | Underhill | |
| 2,942,217 | A * | 6/1960 | Ford | 336/205 |
| 3,234,493 | A | 2/1966 | Zwelling et al. | |
| 3,678,428 | A * | 7/1972 | Morris et al. | 336/84 R |
| 3,711,807 | A | 1/1973 | Yamashita et al. | |
| 3,934,332 | A * | 1/1976 | Trunzo | 336/206 X |
| 3,946,350 | A | 3/1976 | Goto | |
| 4,264,887 | A | 4/1981 | Barrett | |
| 5,167,063 | A | 12/1992 | Hulsink | |
| 6,160,464 | A * | 12/2000 | Clarke et al. | 336/205 X |
| 2005/0275496 | A1 | 12/2005 | Pauley, Jr. et al. | |

FOREIGN PATENT DOCUMENTS

| | | | |
|---|---|---|---|
| JP | 58042213 | A * | 3/1983 |
| WO | WO2005119710 | A3 | 12/2005 |
| WO | PCTUS2005018801 | | 12/2006 |

OTHER PUBLICATIONS

Adachi et al, "Manufacture of Synthetic Resin Molded Coil", English Language Translation of JP 58-42213.*
Jan. 10, 2006 Office Action in parent U.S. Appl. No. 10/858,039.

(Continued)

*Primary Examiner* — A. Dexter Tugbang
(74) *Attorney, Agent, or Firm* — Paul R. Katterle

(57) ABSTRACT

A method of forming a transformer coil, wherein first and second fibrous layers are provided. Each of the first and second fibrous layers includes a fabric formed from a plurality of interconnected fibers and a plurality of spacers affixed to the fabric and protruding therefrom. A conductor layer is disposed over the first fibrous layer such that a first side of the conductor layer contacts the spacers of the first fibrous layer. The second fibrous layer is disposed over the conductor layer such that a second side of the conductor layer contacts the spacers of the second fibrous layer. A resin is applied so as to cover the conductor layer and the first and second fibrous layers.

13 Claims, 7 Drawing Sheets

OTHER PUBLICATIONS

May 10, 2006 Applicant Response to Jan. 10, 2006 Office Action in parent U.S. Appl. No. 10/858,039.
Jul. 31, 2006 Office Action in parent U.S. Appl. No. 10/858,039.
Sep. 29, 2006 Applicant Response to Jul. 31, 2006 Office Action in parent U.S. Appl. No. 10/858,039.
Nov. 3, 2006 Office Action in parent U.S. Appl. No. 10/858,039.
Feb. 5, 2007 Applicant Response to Nov. 3, 2006 Office Action in parent U.S. Appl. No. 10/858,039.
Feb. 22, 2007 Office Action in parent U.S. Appl. No. 10/858,039.
May 22, 2007 Applicant Response to Feb. 22, 2007 Office Action in parent U.S. Appl. No. 10/858,039.
Appeal Brief in parent U.S. Appl. No. 10/858,039.
Examiner Answer in parent U.S. Appl. No. 10/858,039.
Reply Brief in parent U.S. Appl. No. 10/858,039.
www.merriam-webster.com definition of "attach" Jul. 30, 2009.
www.merriam-webster.com definition of "fasten" Jul. 30, 2009.

* cited by examiner

METHOD OF FORMING A TRANSFORMER COIL

CROSS-REFERENCE TO RELATED APPLICATION

This application is a divisional patent application of, and claims priority from, U.S. patent application Ser. No. 10/858,039, filed on Jun. 1, 2004, which is hereby incorporated by reference in its entirety.

BACKGROUND

Transformer coils used in high-voltage and other applications are formed by winding a conductor and casting and curing a thermosetting resin composition around the conductor windings to form a resin body covering the coil. The resin body provides dielectric properties to the transformer coil assembly, as well as holding the conductor windings in place. The resin also provides protection and more uniform thermal properties to the coil assembly. Without some form of support structure for the coil assembly, the resin may develop cracks during casting or during use when the assembly is subjected to external conditions, such as high temperature, high humidity, moisture penetration and the like, or due to internal factors, such as heat generation or stress due to high current flow, electrical fault conditions, and the like.

The resin body is subjected to thermal forces from coil temperatures well above ambient during operation due to $I^2R$ losses in the conductors, from eddy currents, from hysteresis losses in the core, and from stray flux impinging the axial ends of the windings. Further, the resin body may be subject to vibratory forces during operation. The resin body should satisfactorily restrain, resist, and withstand all of these forces over long term operation.

SUMMARY

A method of forming a transformer coil is disclosed that includes providing a fibrous layer that includes a fabric formed from a plurality of interconnected fibers and a plurality of spacers affixed to the fabric and protruding therefrom. A conductor layer is disposed over the fibrous layer such that a first side of the conductor layer contacts the spacers. A resin is applied so as to cover at least the fibrous layer and the conductor layer with the resin.

BRIEF DESCRIPTION OF THE DRAWINGS

Objects and advantages will become apparent to those skilled in the art upon reading this description in conjunction with the accompanying drawings, in which like reference numerals have been used to designate like elements, and in which.

DETAILED DESCRIPTION

Figure 1:
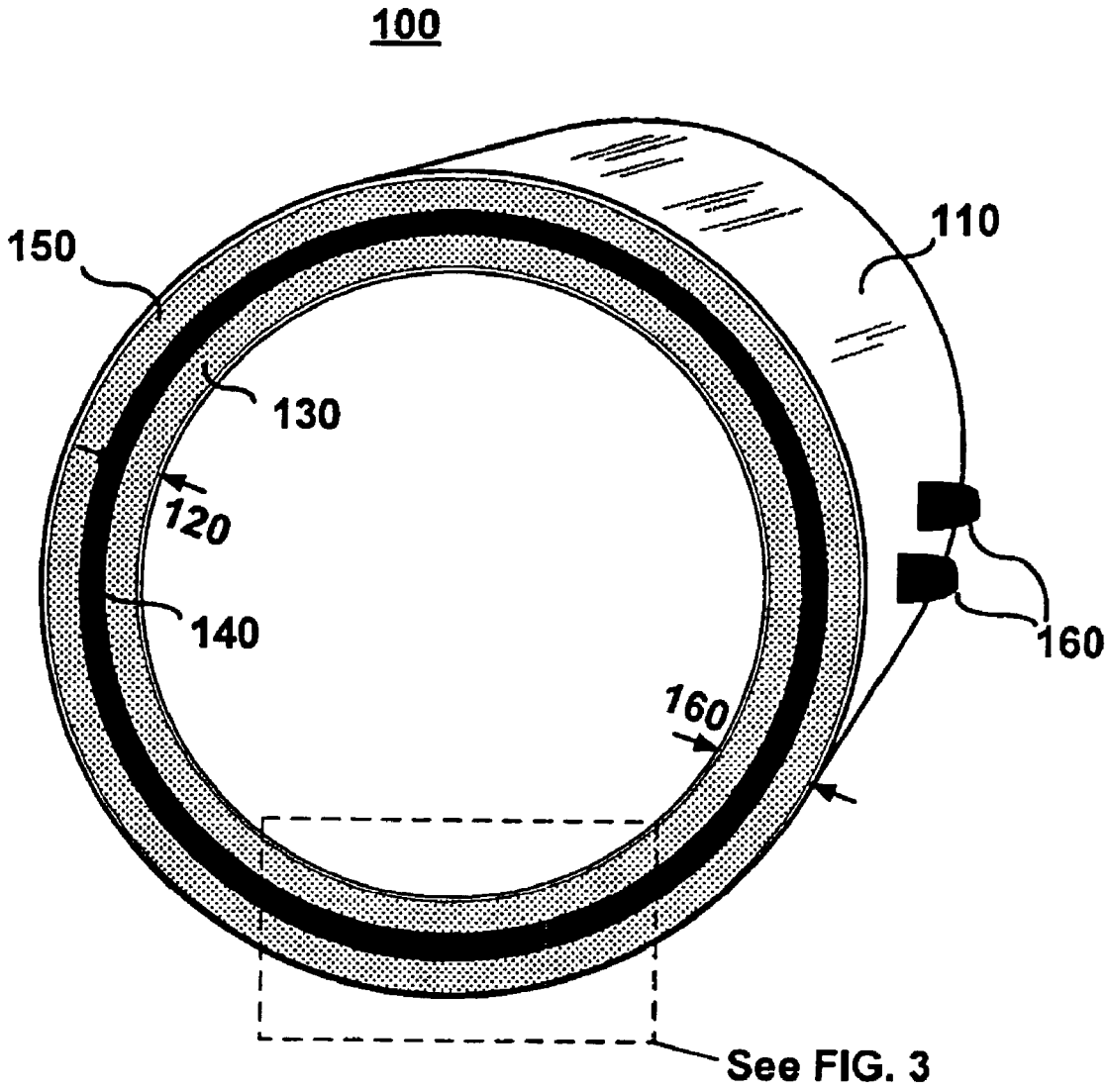
FIG. 1 is a perspective view of a transformer coil assembly.
Figure 3:
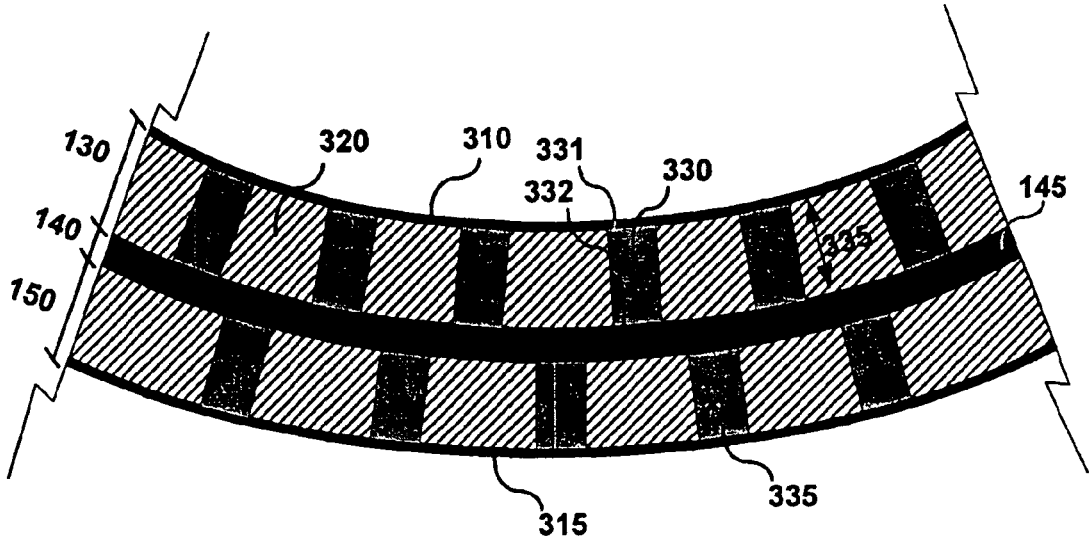
FIG. 3 shows an area of detail of the transformer coil assembly of FIG. 1.

FIG. 1 is a perspective view of a transformer coil assembly 100 according to an exemplary embodiment. The transformer coil assembly 100 includes a first layer 130 and a second layer 140. Referring also to FIG. 3, which details an area of the transformer coil assembly 100 of FIG. 1, a first layer 130 of the transformer coil assembly 100 includes means for establishing a support structure 310.

The means for establishing a support structure 310 can include multiple fibers interconnected to form a fabric. The fabric can include glass fibers and can include electrical grade glass. The fabric can include any of a variety of fibers that are known in this art to be suitable for transformer cast applications, such as polyphenylene sulfide (PPS), polyamides (nylon), polyvinyl chloride (PVC), flouropolymers (PTFE), and the like.

The first layer 130 of the transformer coil assembly 100 also includes spacer means 330, affixed to the support structure means 310. The spacer means 330 can include multiple spacers and is preferably formed of a less compressive material than fabric, such as resin or epoxy. The spacer means 330 are affixed to a surface of the support structure means 310. Here, the term "affixed" means that the spacers can be secured adjacent to a surface of the support structure means 310, by adhesives or other known means, or can be partially embedded in the support structure means 310. The spacer means 330 protrude from the support structure means 310 by a distance, i.e., height, 335. It should be appreciated that although the spacer means 330 are shown affixed to only one surface of the support structure means 310, the spacer means 330 can also be attached to both opposing surfaces of the support structure means 310.

The second layer 140 includes a conductor means 145 in contact with at least one of the spacers of the spacer means 330 on a second side 332 of each spacer that opposes the first side 331. The conductor means 145 can be a single conductor that is wound continuously to form a single transformer coil winding, or can be multiple conductors, depending on the type of transformer coil assembly 100. The conductor means 145 can include tabs 160 for accessing the conductor means 145 by other electrical components outside the transformer coil assembly 100.

The transformer coil assembly 100 includes a dielectric means for covering the support structure means 310, the spacer means 330, and the conductor means 145. The dielectric means can be a resin body 110 covering the layers of the transformer coil assembly 100. Although the dielectric means will be described hereinafter as a resin body 110, or simply resin 110, one of skill in this art will recognize that a number of dielectric materials may be used that are suitable for use in a transformer cast. The thickness of the resin body should be uniform to provide dielectric properties that are uniform throughout the transformer coil assembly. Here, the term uniform means substantially the same throughout with some tolerance. A dielectric with favorable properties will resist breakdown under high voltages, does not itself draw appreciable power from the circuit, is physically stable, and has characteristics that do not vary much over a fairly wide temperature range.

The transformer coil assembly 100 can optionally include a third layer 150 having support structure means 315 and spacer means 335. The third layer 150 can be made of the same materials as the first layer, although this is not a requirement. When the optional third layer 150 is employed, the dielectric means, such as a resin body 110, can cover the first, second, and third layers 130, 140, 150, providing an overall thickness 160.

The means for establishing support structure 310 provides reinforcing support to the resin body 110 to prevent the development of cracks during casting or during use when the assembly is subjected to external conditions, such as high temperature, high humidity, moisture penetration and the like, or due to internal factors, such as high coil temperatures or vibratory forces during operation.

The spacer means 330 protrude from the support structure means 310 by a distance 335. The protrusion of the spacer means 330 creates a space 320 between conductor means 145 and the support structure means 310, where the resin 110 can more easily flow during the casting process. That is, without the spacers, the resin would have to "wick" into the support structure, which takes additional time and may produce uneven dispersion of the resin 110. Uneven dispersion produces a resin body 110 that does not have uniform dielectric properties. The spacer means 330 provides a more even resin body 110 having more uniform dielectric properties than using, for example, a support structure 310 only.

Moreover, the height 335 of the spacer means 330 can be selected to provide a desired overall thickness 120 of the first layer 130 using less support structure means 310, such as fabric. That is, to achieve the same thickness 120 of the first layer 130, and therefore the same dielectric properties, without the spacer means 330, many layers of fabric would typically be required. The layers of fabric would not only cause uneven dispersing of the resin 110, as described above, but would be subject to compression by the conductor means 145 as the conductor means 145 is applied, e.g., wound, over the fabric layers. Compression is typically uneven and results in a non-uniform thickness of the first layer, causing non-uniform dielectric properties. The spacer means 330 therefore preferably is less compressive, i.e., is less subject to changes in volume when a force is applied, than the support structure means 310. For example, epoxy spacers are less compressive than layers of electrical grade glass.

Figure 2:
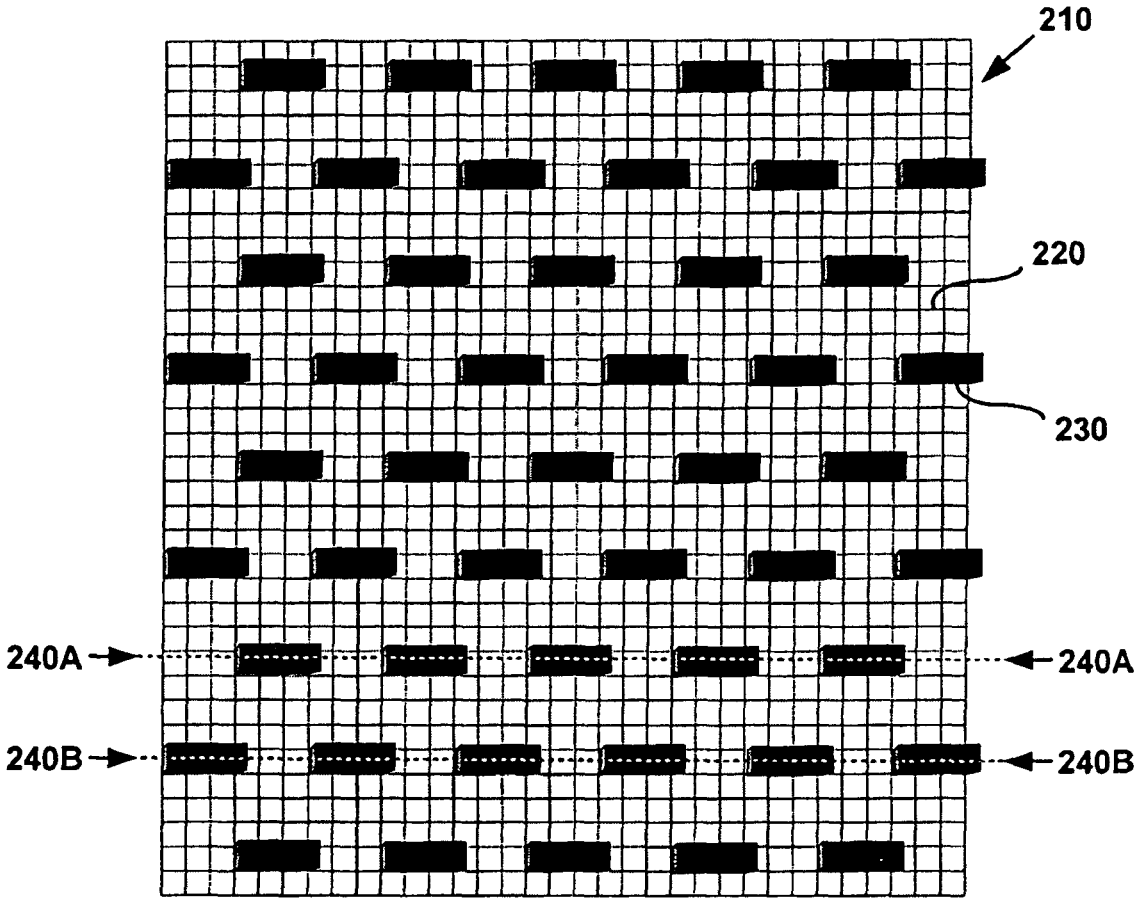
FIG. 2 shows a support structure and spacers.

FIG. 2 shows a support structure 210 with spacers 230. The support structure 210 includes a plurality of fibers 220 interconnected to form a fabric. Although a grid-like pattern is illustrated, any pattern can be used. Multiple spacers 230 are affixed to the fabric 210 and protruding from a surface of the fabric 210.

The spacers 230 can be arranged in a plurality of rows 240A, 240B. The rows 240A, 240B can be segmented as shown. FIG. 2 shows the spacers 230 arranged in one of many patterns that can be used. FIGS. 5A-5D show other possible patterns of the spacers that can be used.

Figure 4B:
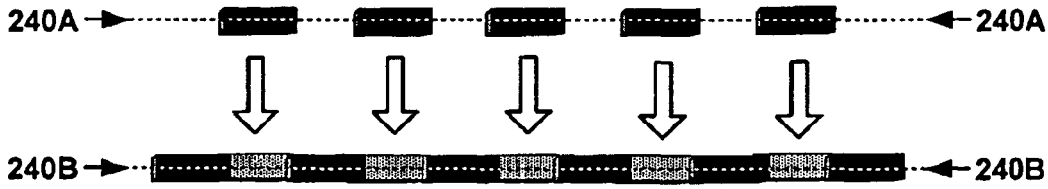
FIG. 4B illustrates a feature of a spacer pattern of FIG. 4A.
Figure 4A:
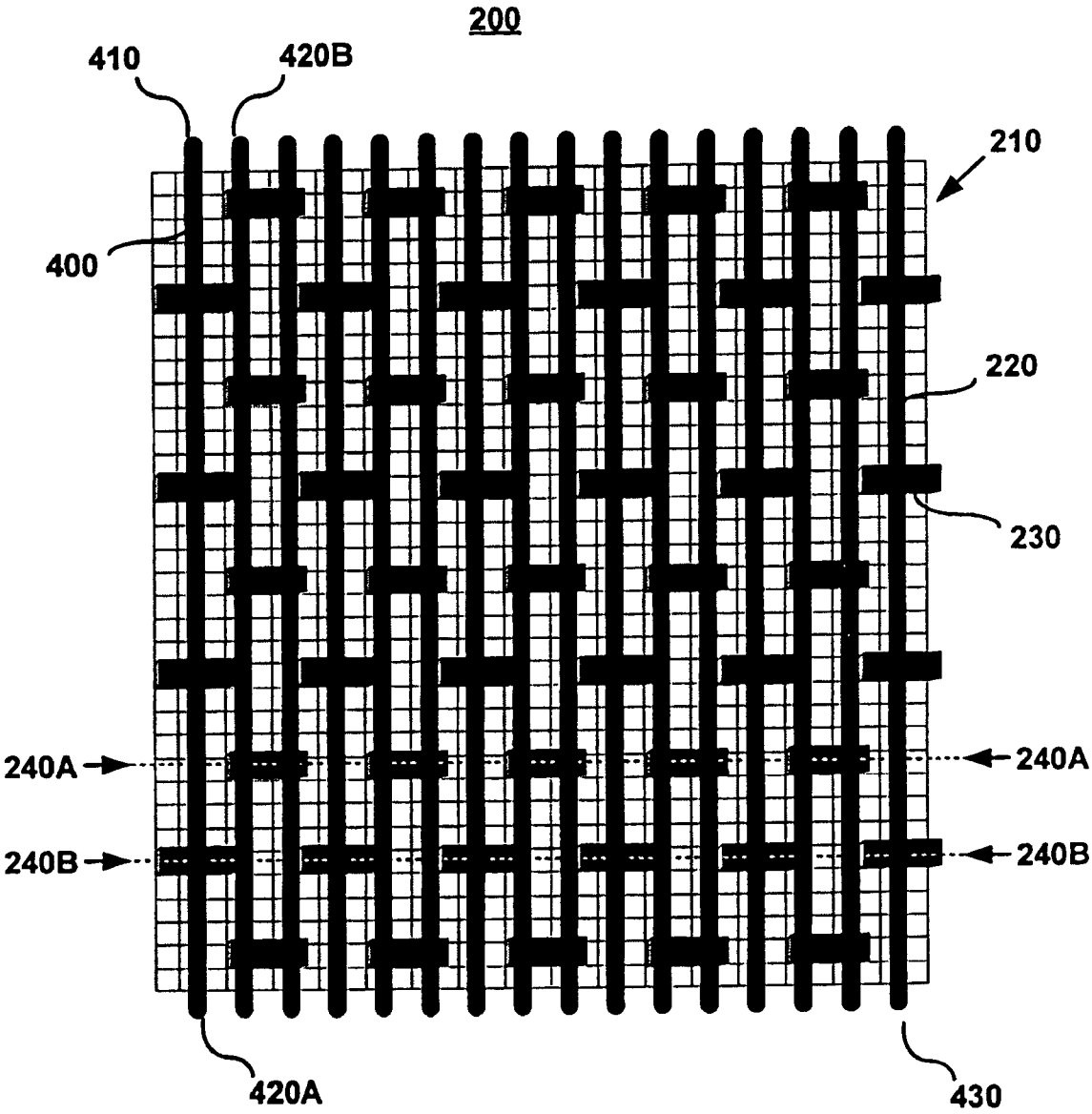
FIG. 4A shows a support structure, spacers, and a conductor.

FIG. 4A shows a support structure, spacers, and a conductor. The spacers 230 are shown arranged in a plurality of rows 240A, 240B. A conductor 430 has a first end 410 and a second end 430 and is continuous such that segment ends 420A and 420B are connected, i.e., represent the same point, and so on. The spacers 230 are shown arranged in a pattern so that the conductor 430 contacts only the spacers 230, and contacts a spacer 230 at least every two rows. This pattern provides support for the conductor 430 every two rows.

Figure 5A:
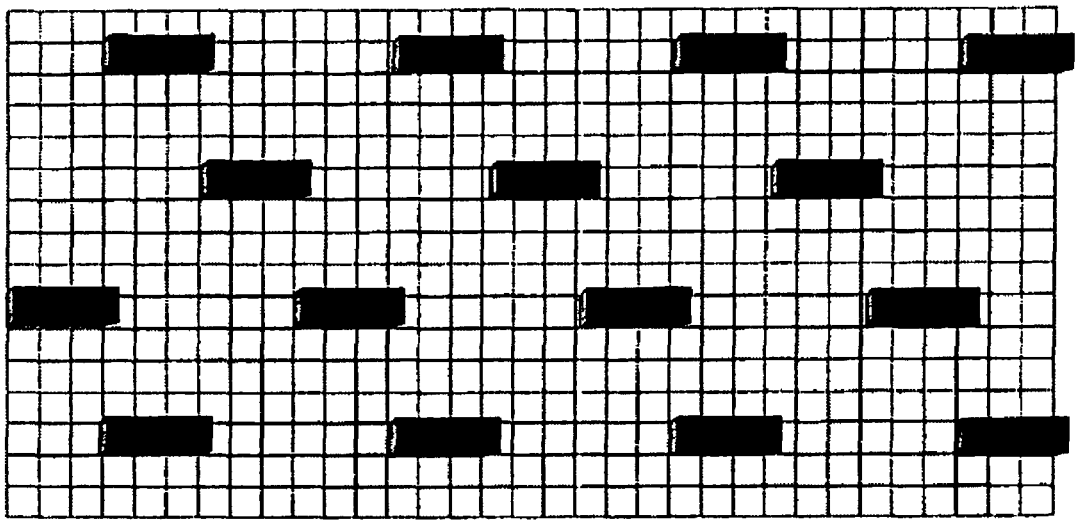
FIGS. 5A-5D show other possible arrangements of the spacers.
Figure 5B:
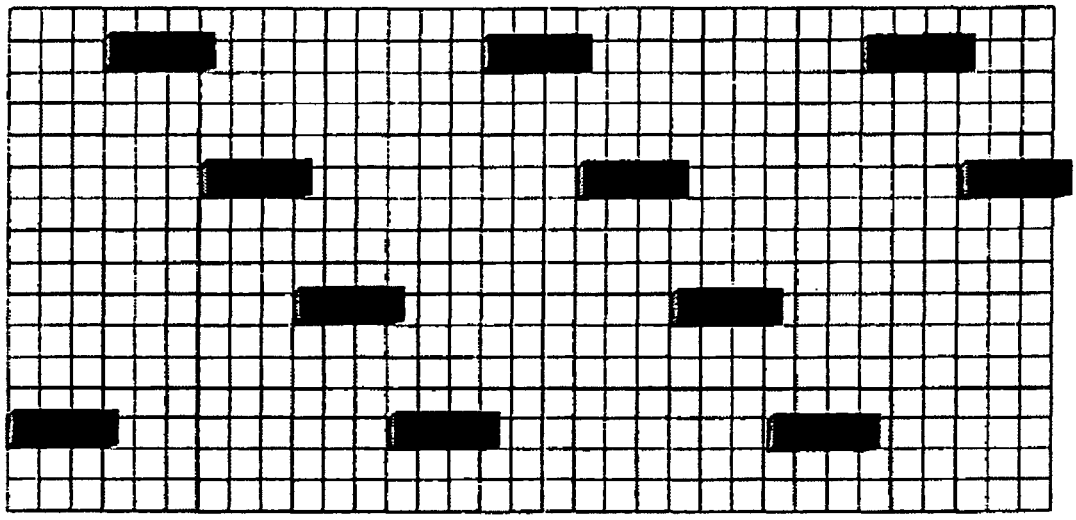

FIG. 4B illustrates this feature of the spacer pattern of FIG. 4A. The superimposition of row 240A onto 240B provides an unsegmented row of spacers. Here, the term "unsegmented" is meant to include both a contiguous row of adjacent spacers and a row of overlapping spacers. This feature helps define the pattern of FIG. 4A. Likewise, as can be appreciated, in the pattern of FIG. 5A, the superimposition of three rows onto each other provides an unsegmented row of spacers. In FIG. 5B, the superimposition of four rows onto each other provides an unsegmented row of spacers. In FIGS. 5A and 5B, the respective pattern provides support for the conductor 430 every three rows and every four rows. This can be expanded to any number of rows.

Figure 5C:
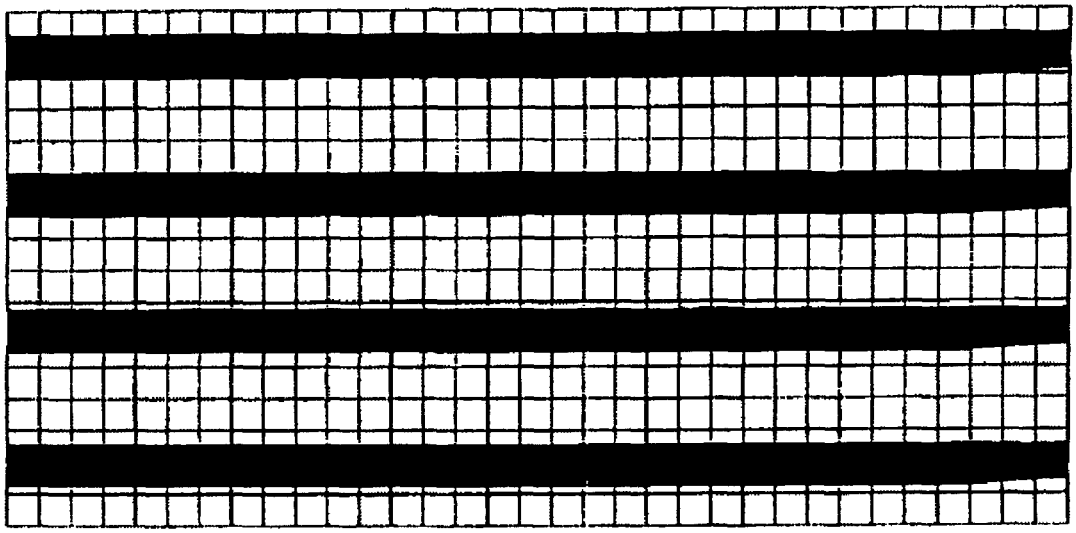
Figure 5D:
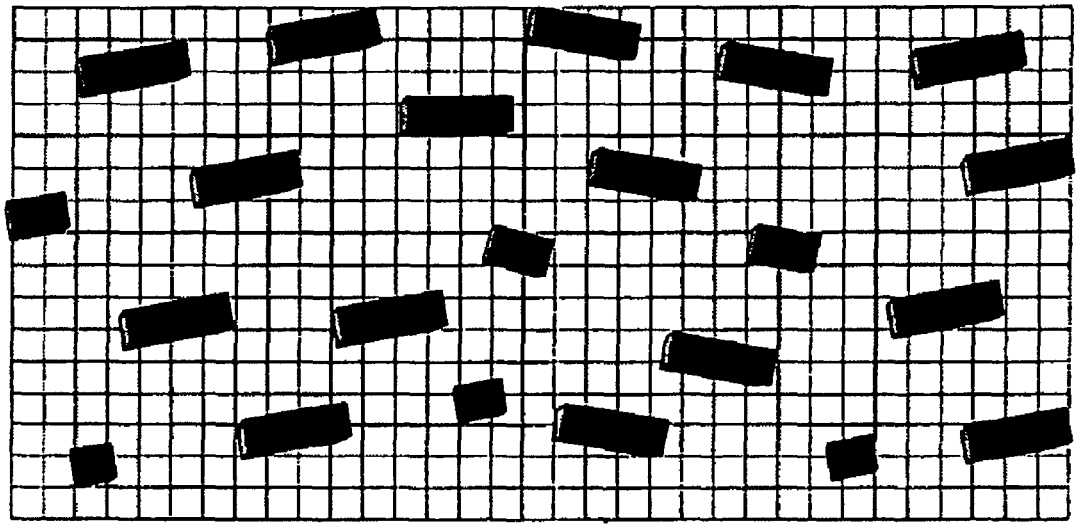

As can be appreciated from FIG. 5C, the rows need not be segmented, although it is preferable as discussed below. Moreover, as can be appreciated from FIG. 5D, the spacers can be of varying sizes and patterns, and need not be in rows. The spacer pattern can be purely random if desired.

It is, however, preferable to use segmented rows of spacers. The segmenting allows better flow of the resin around the spacers. In addition, longer spacers are more likely to conduct electricity from one area of the conductor to another, or create a voltage potential between spacers.

Figure 6:
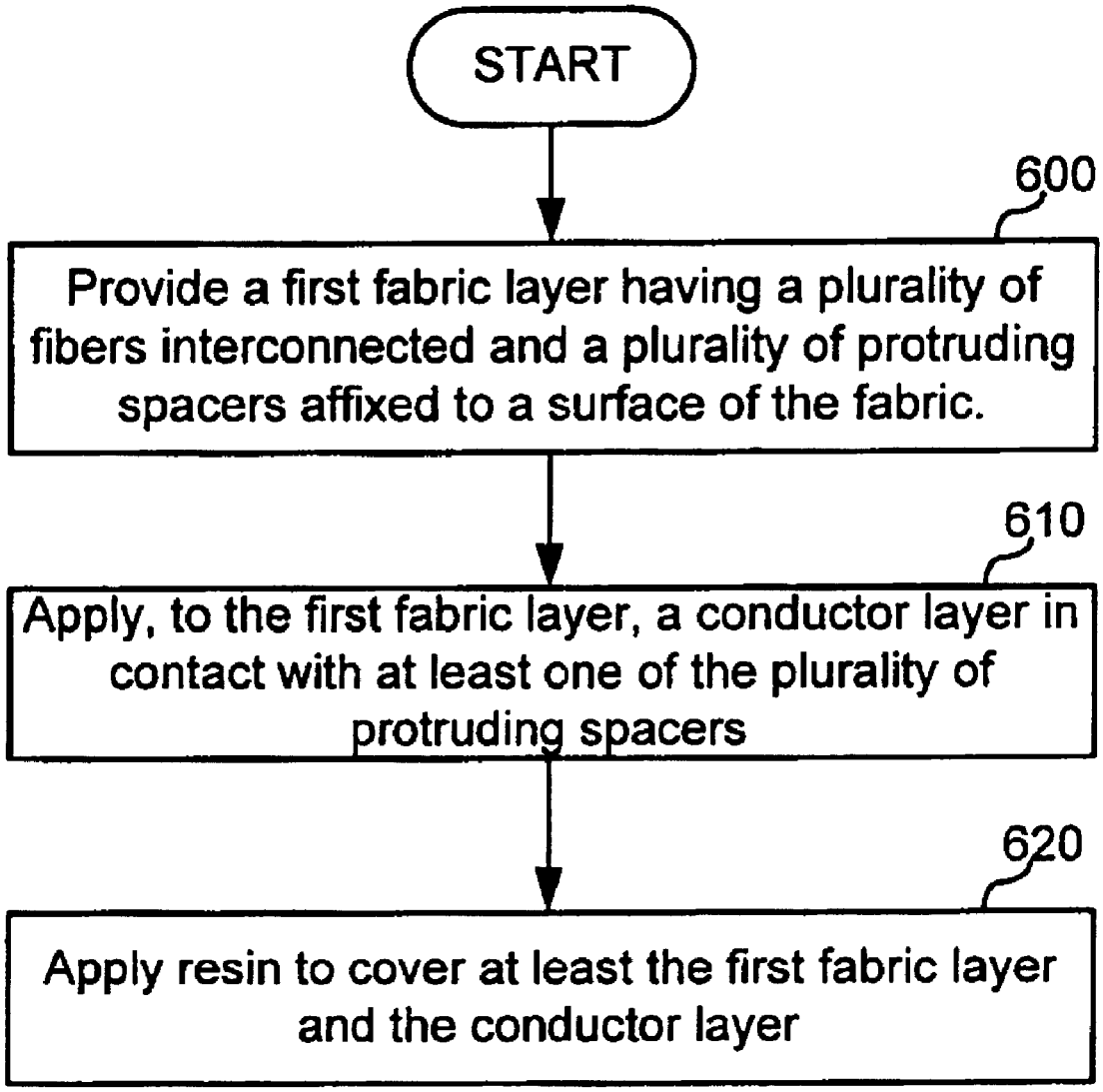
FIG. 6 is a flow chart illustrating a method of forming a transformer coil assembly.

FIG. 6 is a flow chart illustrating a method of forming a transformer coil assembly. A method of forming a transformer coil assembly includes providing a first fabric layer having a plurality of fibers interconnected and a plurality of protruding spacers affixed to a surface of the fabric (600). A conductor layer is applied to the first fabric layer in contact with at least one of the plurality of protruding spacers (610). A resin is applied to cover at least the first fabric layer and the conductor layer (620).

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

It should be emphasized that the terms "comprises", "comprising", "includes" and "including" when used in this description and claims, are taken to specify the presence of stated features, steps, or components, but the use of these terms does not preclude the presence or addition of one or more other features, steps, components, or groups thereof.

What is claimed is:

1. A method of forming a transformer coil, the method comprising:

providing a fibrous layer comprising a fabric formed from a plurality of interconnected fibers and a plurality of spacers affixed to the fabric and protruding therefrom;

providing a conductor layer;

after providing the fibrous layer and the conductor layer, disposing the provided conductor layer over the provided fibrous layer such that a first side of the provided conductor layer contacts the spacers; and applying a resin so as to cover at least the fibrous layer and the conductor layer disposed thereon with the resin; and wherein the spacers are arranged in a plurality of rows on the fabric, and wherein in each row, the spacers are separated by spaces.

2. The method of claim 1, wherein the disposal of the provided conductor layer over the provided fibrous layer is performed such that the conductor layer only contacts the fibrous layer at the spacers.

3. The method of claim 1, wherein the provided fibrous layer is a provided first fibrous layer and wherein the method further comprises:

providing a second fibrous layer comprising a second fabric formed from a plurality of interconnected fibers and a plurality of second spacers affixed to the second fabric and protruding therefrom; and disposing the provided second fibrous layer over the provided conductor layer such that a second side of the provided conductor layer contacts the second spacers of the provided second fibrous layer; and wherein the step of applying the resin is performed so as to cover the provided first and second fibrous layers and the provided conductor layer with the resin.

4. The method of claim 3, wherein the disposal of the provided second fibrous layer over the provided conductor layer is performed such that the provided conductor layer only contacts the provided second fibrous layer at the second spacers of the provided second fibrous layer.

5. The method of claim 1, wherein the rows of spacers comprise a plurality of first rows and a plurality of second rows, wherein the spacers in the first rows are offset from the spacers in the second rows, and wherein the first rows and the second rows are arranged in an alternating manner.

6. The method of claim 1, wherein the transformer coil is cylindrical and the rows extend in the axial direction of the transformer coil.

7. The method of claim 1, wherein the spacers are partially embedded in the fabric.

8. The method of claim 7, wherein the fibers comprise glass fibers.

9. The method of claim 8, wherein the spacers are comprised of an epoxy resin.

10. The method of claim 1, wherein the application of the resin fills spaces between the conductor layer and the fabric with the resin, thereby forming an insulating layer having a uniform thickness.

11. The method of claim 10, further comprising: selecting a height for the spacers based on a desired thickness for the insulating layer.

12. The method of claim 1, wherein the step of providing the fibrous layer comprises securing spacers to the fabric using an adhesive.

13. The method of claim 1, wherein the fabric has a grid pattern.

* * * * *